United States Patent [19]

Kim

[11] Patent Number: 4,827,743

[45] Date of Patent: May 9, 1989

[54] COMBINATION LOCK

[76] Inventor: Sung B. Kim, 4418 Pickett Rd., Fairfax, Va. 22032

[21] Appl. No.: 222,624

[22] Filed: Jul. 21, 1988

[51] Int. Cl.[4] ..... E05B 37/00

[52] U.S. Cl. ..... 70/214; 70/313; 70/315

[58] Field of Search ..... 70/313, 315, 297, 298, 70/299, 214

[56] References Cited

U.S. PATENT DOCUMENTS 2,494,015 1/1950 Tate ..... 70/313

3,751,951 8/1973 Gridley ..... 70/313

4,627,250 12/1986 Kim ..... 70/214

*Primary Examiner*—Robert L. Wolfe

*Attorney, Agent, or Firm*—Technical Patent Institute

[57] ABSTRACT

A combination locking assembly comprising a mechanism wherein the actuation push buttons are jammed and prevented from being depressed when a single one of the push buttons is already depressed. The combination locking assembly further having combination resetting means including a panel which pivots in a first direction and clears the combination and also assists in setting the new combination by pivoting in a second direction.

12 Claims, 5 Drawing Sheets

FIG. 6
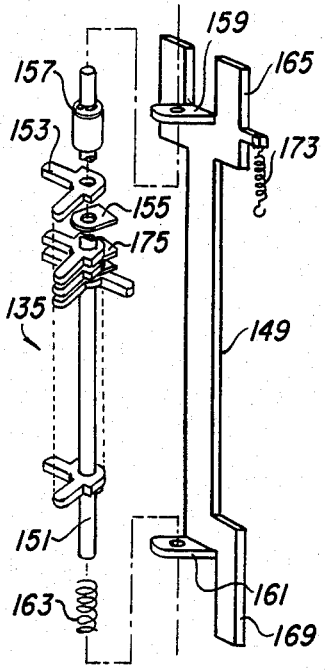
FIG. 7
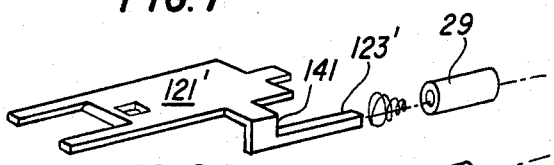
FIG. 8
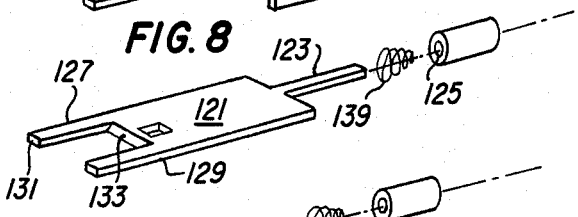
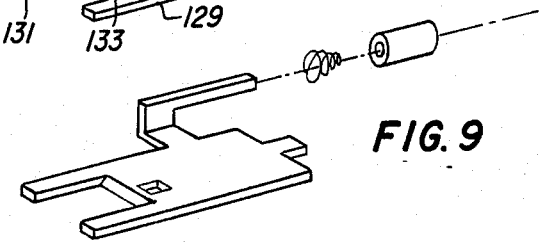
FIG. 9
FIG. 11
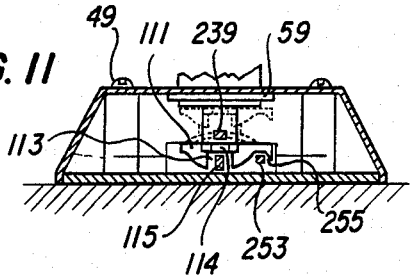
FIG. 10
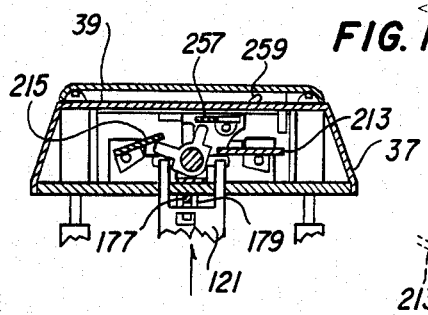
FIG. 13
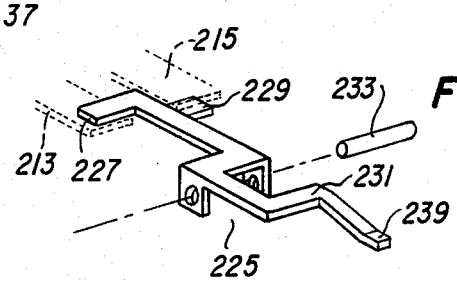
FIG. 12
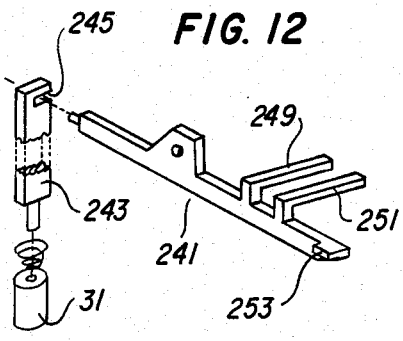
FIG. 14
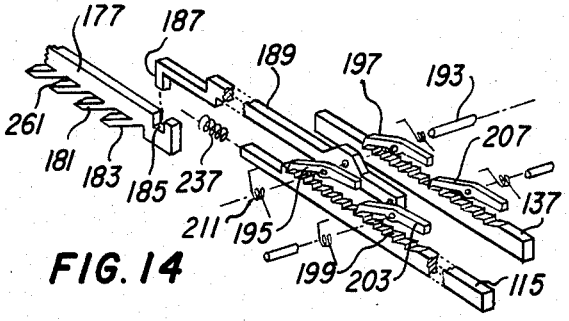

COMBINATION LOCK

FIELD OF THE INVENTION

The present invention relates to combination locks for installation in doors having conventional latch bolt latching assemblies. More particularly, the present invention relates to a push button combination lock assembly wherein the same numeric can be used on multiple occasions in a selected combination. Further, the lock assembly includes apparatus for changing the selected combination which requires only limited mechanical knowledge of the combination assembly. This invention also relates to a combination lock wherein once a push button is depressed, other push buttons are prevented from being simultaneously depressed.

BACKGROUND OF THE INVENTION

The combination lock according to the present invention is an improvement on the combination locking mechanism disclosed in U.S. Pat. No. 4,627,250. This combination lock assembly, although improved over the art which proceeded it, contained several disadvantages which became apparent to the designer after much experimentation. The above noted disadvantages were inherent in the design of the previous combination locking mechanism and required a substantial revision of the locking assembly so as to overcome the disadvantages.

The first disadvantage of the previous assembly relates to the uneven pressure required to depress the push buttons once a single push button has already been depressed. If an operator of ill intention has equipment capable of sensing the uneven pressure, the initial combination number of a set combination could be sensed by sequentially depressing all of the numbers on the push button pad while simultaneously holding down another one of the numeric push buttons. Hence, the initial combination setting could be derived from trial and error.

The second disadvantage of the previous locking mechanism relates to the method by which the combination is set. The combination of the previous locking mechanism is set by an operator manually rotating the combination interposers by use of a pin or other slender object. If an operator is not sufficiently mechanically skilled, resetting the combination could become quite cumbersome.

The third disadvantage associated with the previous locking assembly relates to the length of the stroke of the push buttons when actuating the combination assembly. Owing to the advantageous configuration of the separate parts of the present lock assembly, the present invention lock assembly results in a significantly reduced button stroke. Hence, operation of the mechanism is more convenient.

The present invention is the result of a substantial redesign of the previously proposed locking mechanism and eliminates the disadvantages associated therewith.

SUMMARY OF THE INVENTION

A combination locking assembly according to the present invention includes an advance bar which is engaged and incremented by the push bars of the push buttons on the push button pad. The advance bar is incremented upwardly when the push bar is depressed by the push button. When a single push button has been depressed, the advance bar is incremented to a position such that additional push buttons cannot be depressed owing to the jamming action of the advance bar against the remaining push buttons and associated push bars. In this way, an operator with ill intentions cannot, by trial and error, press a plurality of push buttons while simultaneously seeking to unravel the set combination.

A combination locking assembly according to the present invention also includes a combination setting assembly which simplifies the combination setting procedure. The present invention includes a lever actuated panel which urges the combination interposers to their respective correct and incorrect positions after appropriate actuation of the combination push buttons by an operator. This new combination setting mechanism requires no tools or particular mechanical aptitude on the part of the operator.

The present combination locking assembly also includes a push button stroke which is substantially shorter than the stroke of the push buttons in the previous locking mechanism. Specifically, the present invention contemplates a push button stroke which engages and moves the combination assembly, associated advance bars, and locking pawls through substantially the entire stroke of the push button. In this way, the stroke is substantially reduced and an operator is provided with a mechanical resistance throughout the entire stroke of the push button.

Other objects, features and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numeral designate corresponding parts in the various figures.

BRIEF DESCRIPTION OF THE DRAWINGS

FIG. 6 is an exploded view of a combination assembly according to the present invention.

FIG. 7 is an exploded view of a push bar assembly used for the push buttons of the left most button column of FIG. 2.

FIG. 8 is an exploded view of a push bar assembly used for the push buttons of the center button column of FIG. 2.

FIG. 9 is an exploded view of a push bar assembly used for the push buttons of the right most column of FIG. 2.

FIG. 10 is a cross sectional view of a combination lock according to the present invention taken along line 10—10 of FIG. 4.

FIG. 11 is a cross sectional view of a combination lock according to the present invention taken along line 11—11 of FIG. 4.

FIG. 12 is an exploded view of clear bar and associated clear button according to the present invention.

FIG. 13 is an elevational view of a swing arm according to the present invention.

FIG. 14 is an exploded view of the advance bar, secondary advance bar, advance ratchet, locking ratchet and associated pawls according to the present invention.

DESCRIPTION OF THE PREFERRED EMBODIMENT

Figure 2:
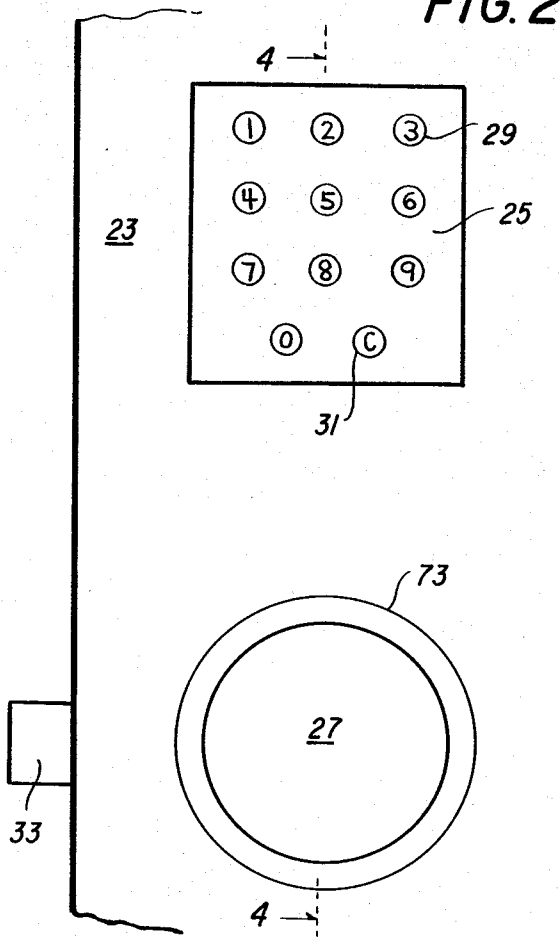
FIG. 2 is an elevational view of the exterior side of the door illustrated in FIG. 1.
Figure 1:
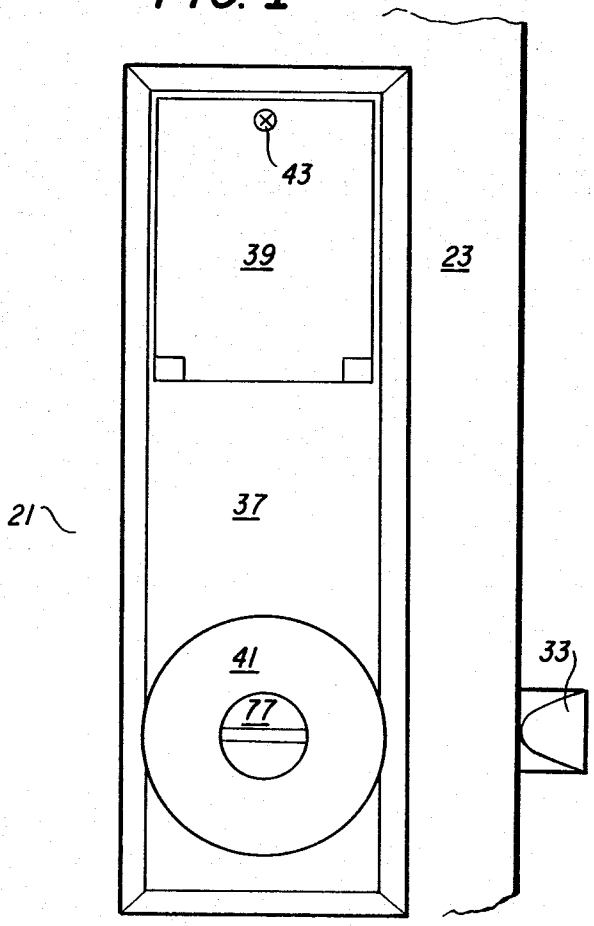
FIG. 1 is an elevational view of the interior side of a door with a combination lock according to the present invention in place.

A combination lock in accordance with the present invention is shown in FIGS. 1 and 2 and is designated therein by the reference character 21.

As shown, the combination lock 21 is installed in a door 23 of conventional design. The door 23 includes an exterior side (FIG. 2) having an exterior plate 25 and an exterior door knob 27. A plurality of user-depressible numeric push buttons 29 (labelled 0 through 9), and a separate clear button 31 (labelled "C"), extend through corresponding clearance openings in the exterior plate 25. As explained more fully below, the push buttons 29 are depressible in a user-determined access combination or sequence to effect unlocking of the combination lock 21. The clear button 31 functions to clear or reset the combination lock 21 in the event that an incorrect one of push buttons 29 is mistakenly depressed.

When the push buttons 29 are depressed in proper sequence, the exterior door knob 27 can be rotated to retract conventional latch bolt (or dead bolt) 33 from a cooperating latch plate mounted in the door frame (not shown) so as to allow opening of the door 23.

The interior side of the door 23 (FIGS. 1 and 3) includes an interior base plate 35, an interior cover 37 with a protective cover 39, and an interior door knob 41. The protective cover 39 is held in place by a threaded fastener 43 at an upper end thereof and by a mounting shaft 45 and support walls 47 at the lower end.

Figure 3:
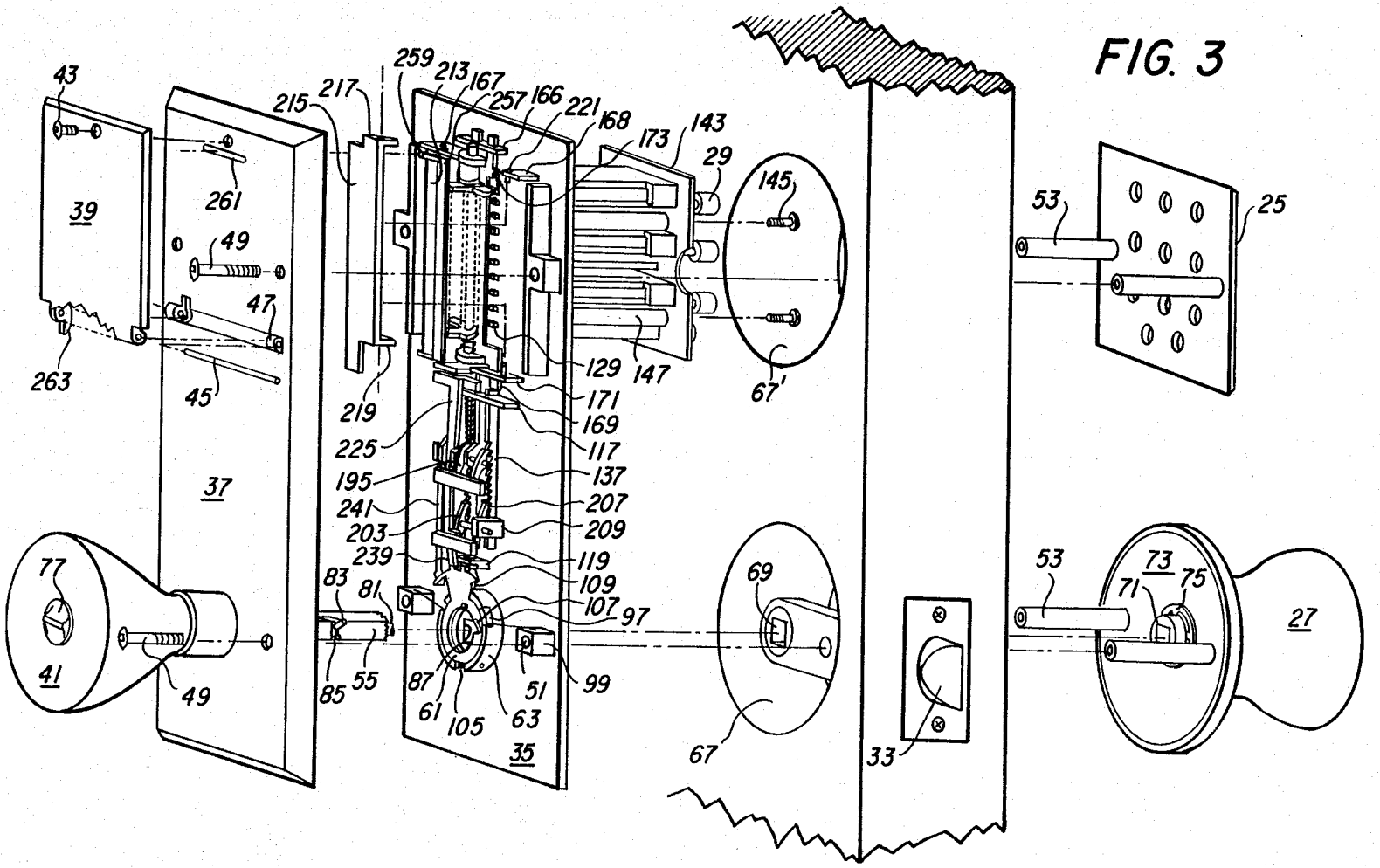
FIG. 3 is an exploded view of a combination lock according to the present invention.
Figure 4:
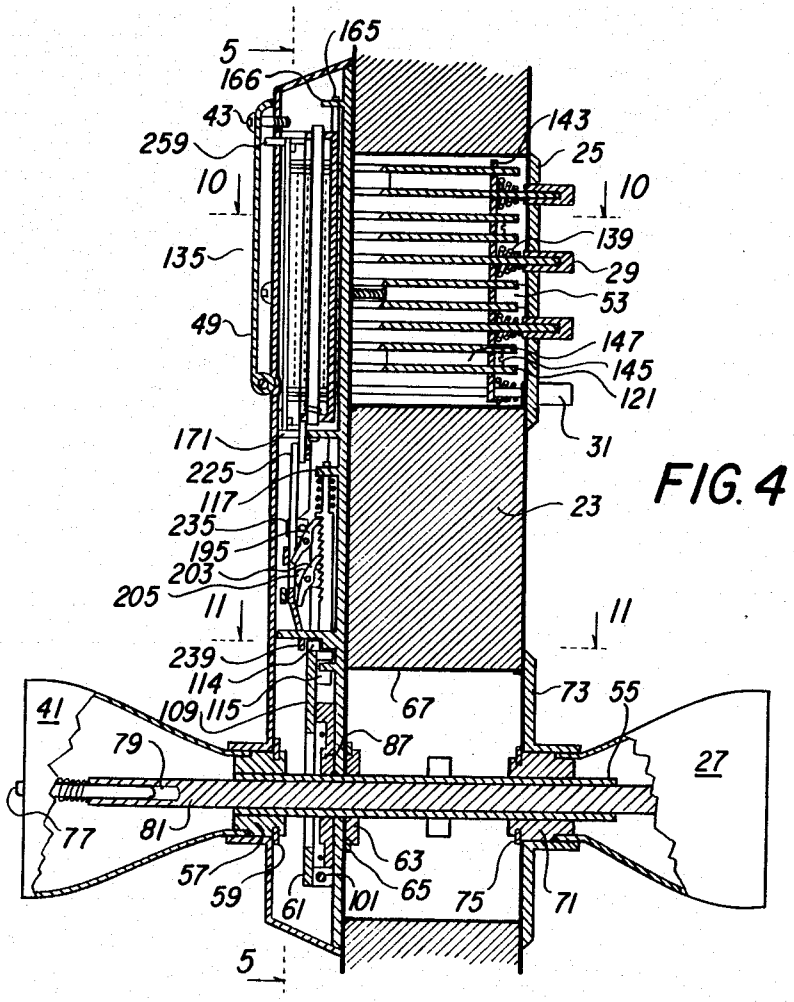
FIG. 4 is a side cross sectional view of a combination lock assembly according to the present invention taken along line 4—4 of FIG. 2.

The interior base plate 35, the exterior plate 25, and door knobs 27 and 41 are mounted on the door 23 in general registration with one another as shown in FIGS. 3 and 4. The combination lock mechanism is mounted on the interior base plate 35 with the exterior and interior door knobs 27 and 41 mounted on a common axis below the combination lock mechanism. The interior base plate 35, the exterior plate 25, and the exterior door knob 27 are connected by threaded fasteners 49 passing through clearance bores 51 in the interior base plate 35. The fasteners 49 engage corresponding threaded studs 53 in the exterior plate 25 and the exterior knob assembly.

As shown in FIG. 4, a square tube 55 is pressure fit into the interior knob shaft 57. The interior knob shaft 57 is rotatably mounted in the interior cover 37 in an appropriate clearance bore and retained in place by an E-ring 59. The square tube 55 extends through the circular clearance bore in the center of a locking disc 61 and a square bore in the center of a mounting shaft 63. The mounting shaft 63 is rotatably mounted in the interior base plate 35 and retained in its place by an E-ring 65. The square tube 55 further extends through a bore 67 in the door 23. The tube 55 also extends through square bore 69 in the conventional latch bolt assembly and the square bore in the exterior knob shaft 71.

As shown in FIG. 3, the exterior knob shaft 71 is rotatably mounted in the exterior knob disc 73 and secured in place by an E-ring 75.

Figure 18:
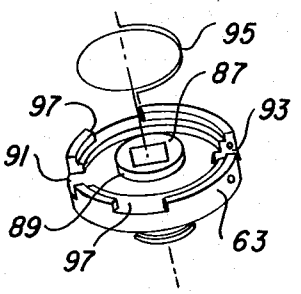
FIG. 18 is an isometric view of the mounting shaft and associated return spring according to the present invention.

As shown in FIGS. 3 and 4, an unlocking tab 77 is rotatably installed in the center of the interior door knob 41. The inside end of the unlocking tab 77 extends through the oval hole 79 made in a spindle 81 that extends axially through the square tube 55. A pin 83 is pressure fit into the spindle 81 (FIG. 3) and extends radially through slot 85 in the square tube 55. The pin 83 and the slot 85 are so positioned on the square tube 55 that, when the lock is assembled, the pin 83 will be positioned between the core surface 87 of the mounting shaft 63 (FIG. 18) and the locking disc 61 (FIG. 4). As shown in FIGS. 18 and 4, the mounting shaft 63 has a core shaft 89 with a square hole (unnumbered) in the center to fit on the square tube 55. On the extended circumference of the mounting shaft 63 are two clearance slots 91 and 93 to receive the locking disc 61. A return spring 95 is mounted on the core shaft 89 and extends through a pair of slots 97. Return spring 95 is anchored on the studs 99 of the base plate 35 (FIG. 3) to urge the mounting shaft 63 to its initial position.

Figure 5:
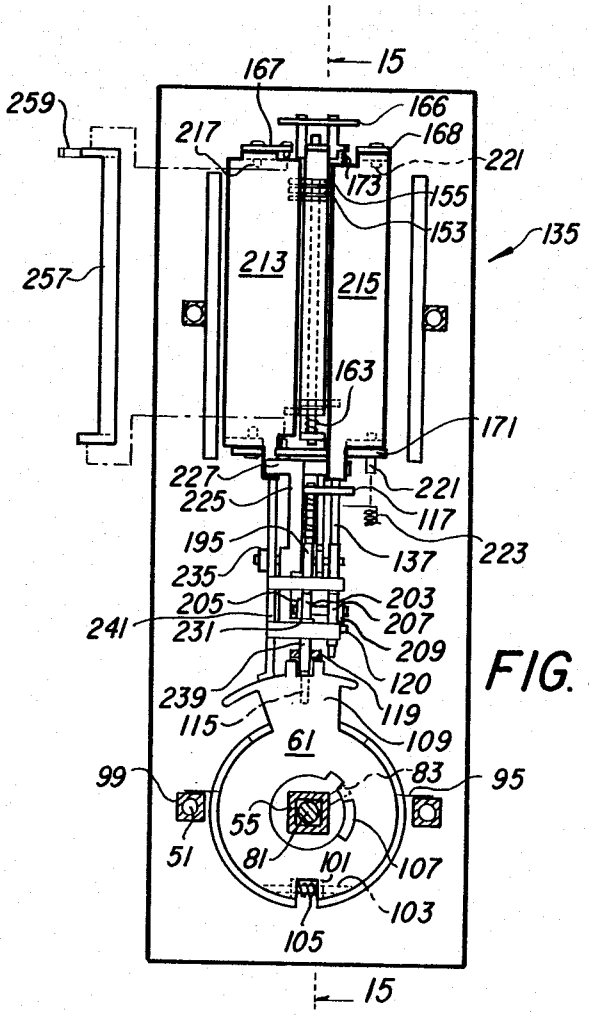
FIG. 5 is a cross sectional view of a combination lock according to the present invention taken along line 5—5 of FIG. 4.
Figure 17:
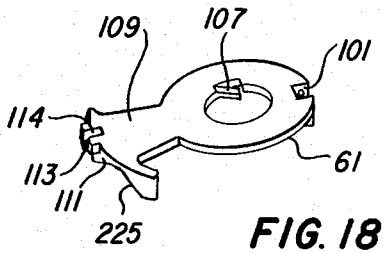
FIG. 17 is an isometric view of a locking disc according to the present invention.

The locking disc 61, shown in FIGS. 17 and 5, is pivotally mounted on the mounting shaft 63 at apertured tabs 101 by a pin 103 (FIG. 5) which extends through the slot 93 of the mounting shaft 63 and the apertured tabs 101. A torsion spring 105 is mounted on the pin 10 to resiliently bias the locking disc 61 toward the mounting shaft 63. The locking disc 61 includes a center bore large enough for the square tube 55 to rotate freely. The locking disc also includes a ramped surface 107 on its inner circumference. The other end of the locking disc 61, opposite apertured tabs 101, extends through the slot 91 in the mounting shaft 63 and comprises a locking pawl 109. As shown in FIGS. 17 and 11, the distal end of the locking pawl 109 has two generally triangularly shaped tabs 111 bent toward the interior base plate 35. Between these two tabs 111 is a slot 113, to receive the lower end of a locking ratchet 115, and slot 114, to provide clearance for receiving pivoting flange 239 of swing arm 225. (The locking ratchet 115 moves up and down in its support walls 117 and 119 in a manner described later (FIGS. 4 and 5)).

When the door lock is in a locked condition, the lower end of the locking ratchet 115 is in the slot 113 of the locking pawl 109 as shown in FIGS. 4 and 5. This interengagement of the slot 113 and ratchet 115 prohibits the locking disc 61 from rotating. Were an operator to attempt to rotate either of the interior or exterior door knobs to open the door, it would cause the square tube 55 to begin to rotate. The rotation of the square tube 55 will, in turn, cause the mounting shaft 63 to rotate. The locking disc 61, connected to the mounting shaft 63, will be forced to rotate. However, since the lower end of the locking ratchet 115 is in the slot 113 in the locking pawl 109, the locking disc 61 cannot rotate and the door knob, either exterior or interior, is prohibited from rotating.

If it is desired to leave the door unlocked, the unlocking tab 77 can be turned clockwise from inside. When this unlocking tab 77 is turned clockwise in FIG. 1, it will cause the spindle 81 to turn with the pin 83. (FIGS. 3 & 4). As it can be appreciated from the FIGS. 3 and 5, the rotation of the pin 83 against the ramped surface 107 will lift the locking disc 61 away from the base plate 35 (FIG. 11). When the locking disc 61 is lifted high enough to clear the lower end of the locking ratchet 115, at slot 113, as shown in exaggerated form in FIG. 11 by dotted line, the locking disc 61 will be free to turn. Hence, the square tube 55 along with the door knobs will be permitted to turn, thus allowing the door to open.

The latch bolt assembly is of conventional door lock design such that the rotation of the square hole 69 will cause the bolt 33 to retract.

Another method of unlocking the door is to enter the correct combination into the combination assembly shown in FIG. 6 through the key pad shown in FIG. 2. When the locking ratchet 115 is pulled upwards out of the slot 113 by manipulating the push buttons 29 in the manner described below, the locking disc 61 will be again allowed to rotate freely and the door knobs will be permitted to turn and the bolt 33 can be retracted.

As shown in FIGS. 3 and 4, eleven push buttons extend through the holes in the exterior plate 25. These buttons are arranged generally as shown in FIG. 2. The buttons 29 of the center vertical column (buttons labelled 2, 5 and 8), along with their associated push bars 121, have the overall structure shown in FIG. 8. The fork-like push bar 121 includes a stem 123 that is pressure fit in a suitable bore 125 in the button 29. The push bar also includes first and second parallel tines 127 and 129. The remote ends 131 of the tines 127 and 129 define force transmitting surfaces which, as described below, are used to prevent the locking ratchet 115 from making incremental upward movement in case the wrong button is depressed.

As shown in FIG. 8, the push bar also includes a sloped ramp surface 133 which is used to upwardly increment the combination setting assembly, generally numbered 135, locking ratchet 115, and advance ratchet 137 in the manner described below. A spiral spring 139 is provided on the stem 123 to resiliently urge the buttons 29 to their respective undepressed positions.

The push bar structure of the left most column in FIG. 2 (buttons 1, 4, 7 and 0) is shown in FIG. 7. The push bars 121' include an extension shoulder 141 and the stem 123' that is generally parallel to the tines and onto which a button 29 is pressure fit. The push bar structure of the right most column in FIG. 2 (buttons 3, 6 and 9) is similar to that of the push bar 121' of FIG. 7 except that the extension shoulder and the stem are positioned on the opposite side as shown in FIG. 9.

The structures of the push bars for the left, center and right column are such that the various push buttons, when assembled in the exterior plate 25, have their respective tines arranged in an overlying arrangement in parallel vertical planes while the push buttons 29 would appear generally as shown in FIG. 2.

The push buttons 29 and the push bars 121 are mounted between the interior base plate 35 and an intermediate mounting plate 143. Mounting plate 143 is secured (as shown in FIG. 3) by threaded fasteners 145 to fastener receiving studs 147 integrally made on the exterior side of the interior base plate 35. The push buttons 29 pass through appropriate openings in the exterior plate 25 while the remote ends 131 of the tines project through an appropriately sized clearance bore (unnumbered) in the interior base plate 35. The push bars 29, clear button 31 and the intermediate mounting plate 143 extend through another bore 67' in the door toward the exterior side of the door as shown in FIG. 3. The coiled return springs 139 are mounted on their respective stems 123 and bear against the intermediate mounting plate 143 to resiliently urge the respective push bars 121 and push buttons 29 to their initial undepressed positions. When a particular push button 29 is depressed, the remote ends 131 of its tines 127 and 129 advance beyond the interior base plate 35 toward the interior cover 37 to activate the combination assembly 135.

A combination setting assembly, generally designated by the reference character 135, is mounted vertically on the base plate 35 between the remote ends 131 of the tines 127 and 129. As shown in FIG. 6, the combination setting assembly 135 includes a mounting plate 149 and a vertically aligned bar 151 which carries a plurality of combination setting interposer 153 and spacers 155. The positions of the combination setting interposer 153 and spacers 155 alternate on the bar 151 to which they are secured by E-rings 157. As shown in FIG. 6, the upper end of the bar 151 is received in a clearance bore (unnumbered) in the upper support wall 159 of the mounting plate 149. The lower end of the bar 151 is received in a clearance bore (unnumbered) in the lower support wall 161 on the mounting plate 149. A compression spring 163 is provided to urge the bar 151 toward the upper support wall 159.

The fork like top 165 of the mounting plate 149 is received in an appropriate clearance bore (unnumbered) in the upper support wall 166 (FIG. 5) and the bottom end 169 is received in an appropriate clearance bore (unnumbered) in the lower support wall 171. A coil spring 173 is provided to urge the combination setting assembly 135 to its starting position. The combination setting interposers 153 have two arms which are separated by 90 degrees and can be rotated relative to the bar 151 to one of two combination setting positions as shown in FIG. 6. In the preferred embodiment, four combination setting interposers 153 are provided for each of the push buttons 29. The spacers 155 are placed between the combination setting interposers 153. As shown in FIG. 6, the spacer 155 has a flat side 175 that will be placed closely with respect to the mounting plate 149 so that it cannot rotate relative to the bar 151.

Figure 15:
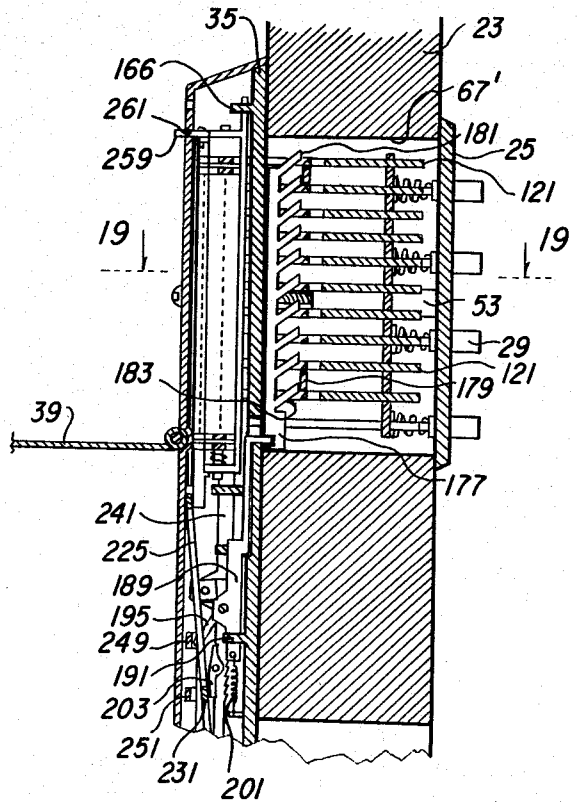
FIG. 15 is a partial cross sectional view of a combination lock according to the present invention taken along line 15—15 of FIG. 5.

As shown in FIG. 15, an advance bar 177 is mounted vertically between the tines 127 and 129 on the exterior side of the base plate 35. The advance bar 177 is mounted for reciprocating movement at its upper end in a clearance bore (not shown), formed in an upper support wall 179 (FIG. 10) which extends generally perpendicularly from the exterior side of the base plate 35, and at its lower end in a similar manner in a lower support wall (not shown). The advance bar 177 includes a plurality of projections 181 corresponding to each push bar in the assembly. Each projection 181 has a ramped surface 183 that complements and interacts with the ramped surface 133 on each push bar 121. As a result, depression of any push button 29, as shown by an arrow in FIG. 16, will cause the associated push bar 121 to advance towards and increment the advance bar 177. When the pushbutton 29 is released, the push bar 121 retracts so as to allow advance bar 177 to return to its initial position.

Figure 16:
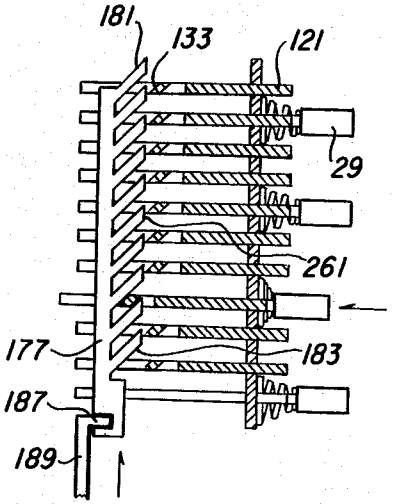
FIG. 16 is a cross sectional view of the advance bar engaged with a push bar.

As best shown in FIGS. 14 and 16, a slot 185 is provided at the lower end of the advance bar 177 to receive the top end 187 of a secondary advance bar 189.

The secondary advance bar 189, engaged with bore 185 at its top (FIG. 14), is mounted for reciprocating movement and is positioned in a clearance bore (not shown) formed in a lower support wall 191 (FIG. 15). Advance pawls 195 and 197 are pivotally carried on each side of the secondary advance bar 189 at its lower end and engage the respective toothed racks 199 of the locking ratchet 115 and the advance ratchet 137. A coiled return spring 201 (FIG. 15) is provided to urge the secondary advance bar 189 and thus the advance bar 177 to their initial position.

The locking ratchet 115 and the advance ratchet 137 are mounted generally on each side of the secondary advance bar 189 and received, at their upper ends, in a clearance bore (unnumbered) formed in the upper support wall 117 (FIG. 5) and, at their lower ends, in another clearance bore formed in the lower support wall 119, for the locking ratchet 115, and another support wall 120, for the advance bar 137. Both locking ratchet 115 and advance ratchet 137 includes toothed racks 199 with the pitch of the individual teeth generally equal to the thickness dimension of a pair of the combination setting interposer 153 and spacer 155.

In addition, a restraining pawl 203, pivotally mounted on a supporting wall surface 205 of the interior base plate 35, also engages the toothed rack 199 on the locking ratchet 115 as shown in FIG. 14. Similarly, another restraining pawl 207 is pivotally mounted on another supporting wall 209 for engagement with the advance ratchet 137. Torsion springs 211 are provided to urge the advance pawls 195, 197 and the restraining pawls 203 and 207 onto the locking ratchet 115 and advance ratchet 137 respectively.

With each depression of the push buttons 29, the engagement of the ramped surfaces 183 and 133, of advance bar 177 and the push bar 121, will cause the advance bar and the connected secondary advance bar 189 to move upwardly as shown in FIG. 16. The advance pawls 195 and 197 on the secondary advance bar 189 will, in turn, cause the locking ratchet 115 and the advance ratchet 137 to move upwardly by a distance equal to the distance between each combination setting interposer 153. The restraining pawls 203 and 207 maintaining the locking ratchet 115 and the advance ratchet 137 in their newly incremented position.

At the same time, the combination setting assembly 135, with its very lower end 169 (FIG. 3) in contact with the very upper end of the advance ratchet 137, will also be forced to move upwardly by the same distance as the advance ratchet 137.

When the locking ratchet 115 has made enough incremental upward moves to clear the slot 113 in the locking disc 61, the door is unlocked in the manner previously described and allowed to open.

As shown in FIGS. 3 and 5, first and second actuation panels 213 and 215 are pivotally mounted between upper and lower support walls 167, 168, and 171. Each of the panels 213 and 215 has a vertical height generally coextensive with the combination setting interposers 153 and have apertured mounting tabs 217 and 219 formed at their upper and lower ends respectfully. These tabs are pivotally received on pins 221 depending from the inner sides of the respective upper support walls 167, 168, and lower support wall 171.

A torsion spring 223 (FIG. 5) is provided on the pin 221 receiving the lower end of the second actuation panel 215 to urge the panel 215 to its initial position generally parallel to the interior base plate 35.

Each of the actuation panels 213 and 215 are movable from their respective initial positions, as represented by the panel 213 in FIG. 10, to a pivoted or extended position, as represented by the position of actuation panel 215 in FIG. 10. When one of the push buttons 29 is depressed, the remote ends 131 of the tines 127 and 129 advance beyond the mounting plate 149 and engage the associated combination setting interposer 153 which, in turn, urges against one of the activation panels 213 or 215.

The combination interposer 153 can be set in one of two orientations (shown in FIG. 6). The tine will rotate the interposer to cause, in turn, the corresponding panel 213 or 215 to pivot as shown in FIG. 10.

The swing arm assembly, shown in FIG. 13 and designated generally therein by the reference character 225, is used to prevent the locking ratchet 115 from advancing in the case where an incorrect push button 29 that is not in the selected combination number is depressed. As shown, the swing arm 225 includes two stepped flanges 227 and 229 at its top and third flange 231 with an apertured tab (unnumbered) between them.

The swing arm 225 is mounted, as best shown in FIGS. 4 and 15, for pivoting motion on a pin 233 (FIG. 13) extending from an appropriately positioned supporting wall surface 235 (FIG. 5) When the lock is assembled, the swing arm 225 is so positioned that the first flange 227 will be on top of the lower end of the first actuation panel 213 and the second stepped flange 229 will be directly under the second actuation panel 215 (FIG. 13). The third flange 231 is positioned directly above the restraining pawl 203 engaged with the locking ratchet 115 (FIG. 15).

As described above, when a push button 29 is depressed, regardless of whether it was correct or not, it will cause the advance bar 177, the secondary advance bar 189, the advance ratchet 137, the mounting plate 149, and the locking ratchet 115 to move upwardly. As the mounting plate 149 moves upwardly, the bar 151 and the interposers mounted thereon are blocked by the tine that travels over the top surface of another interposer 153 directly below the interposer 153 being actuated (FIG. 10). As a result, the relative position of the interposers 153 with respect to the push bars 121 is locked. As the push bar 121 proceeds, with the relative position of the interposers 153 to the push bar maintained, the mounting plate 149 continues to be moved up against the spring 173 and the compression spring 163 by the advance ratchet 137. At the same time, either one of the advancing tines 127 or 129 will come to engage the corresponding interposer 153 to rotate it which will, in turn, pivot either one of the actuation panels 213 or 215, depending on the position of the interposer 153 being actuated.

When the position of the interposer 153 being actuated is such that the first actuation panel 213 is pivoted, the lower end of it will, as can be appreciated in FIG. 13, cause the flange 227 to be lifted. The stepped flange 229, in turn, will lift the second actuation panel 215 against the torsion spring 223. As the flanges 227 and 229 are lifted, the swing arm 225 pivots to cause the third flange 231, as can be best appreciated in FIGS. 3, 13, and 15, to push down the lower end of the restraining pawl 203, disengaging the restraining pawl 203 from the toothed rack 199 on the locking ratchet 115. When the push button 29 is pushed all the way in and released, the restraining pawl 207 will establish a newly incremented position of the advance ratchet 137 and the mounting plate 149. Also, the bar 151 with the combination setting interposers 15 mounted on it will be moved upwardly by the coil spring 163 (FIG. 6 as soon as the tines retracts to clear the blocking interposer 153 that was directly below the interposer just actuated, bringing the next set of the interposers 153 to the position to engage the push bars 121 for the next push bar operation.

In the meantime, the locking ratchet 115 with the associated restraining pawl 203 disengaged from the rack 199 by swing arm 225 will be pushed back to where it was by the coil spring 237. Additional actuation of incorrect push buttons 29, with the corresponding interposers 153 set to the position to actuate only the first actuation panel 213, will result in additional incrementing of only the advance ratchet 137 and the combination setting assembly 135. The locking ratchet 115 will remain at its initial position with its lower end securely in the slot 113 and the door will remain locked.

The very lower end 239 of the swing arm 225 is extended to pivot into the slot 114 (FIG. 17) every time the swing arm 225 is pivoted. This pivoting serves to further prevent the locking disc 61 from rotating when an incorrect button 29 is depressed. Also, since lower flange 239 is placed just above the locking disc 61, it also serves to prevent the locking disc 61 from being forced away from the locking ratchet 115 in the case where the knob is forced to turn while the door is locked (FIG. 11).

For a correct combination entry, the combination setting interposer is set to actuate only the second actuation panel 215. In this manner, only the second actuation panel 215 will be actuated against the torsion spring 223, as can be appreciated in FIGS. 5 and 10, and swing arm 225 remains unmoved. Since the restraining pawl 203 remains engaged with the toothed rack 199, the locking ratchet 115 will increment along with the advance ratchet 137 as the correct push buttons 29 are pushed in the manner described above. As a result, successive actuation of the correct ones of push buttons 29, with the corresponding interposers 153 set to actuate only the second actuation panel 215, will steadily increment the locking ratchet 115 upwardly. When the locking ratchet 115 has moved enough distance upwardly to clear the slot 113, the locking disc 61 can rotate freely and the door is unlocked.

The position of the interposer 153 set to actuate the first actuation panel 213 can be, therefore, designated as an "incorrect" position and the position set to actuate only the second actuation panel 215 can be designated as a "correct" position.

In the case where an operator has made a mistake and wishes to start all over again, the clear bar 241 can be used to reset the lock.

The clear bar 241, shown in FIG. 12, engages the clear push bar 243. Bar 241 is mounted for pivotal movement on the pin 233 extending from the supporting wall surface 235. The clear push bar 243 includes a clearance bore 245 for engagement with the clear bar 241. The clear button 31 is pressure fit on the opposite end of the clear bar 243 from the clearance bore 245. A spiral spring 247 is provided against the intermediate mounting plate 143 to urge the clear push bar 243 and the clear bar 241 to their initial position.

As shown in FIG. 12, the clear bar 241 includes two parallel clear arms 249 and 251 which are positioned so as to be over the advance pawls 195, 197, the restraining pawl 207, and the flange 231 of the swing arm 225. When the clear button 31 is depressed, the clear bar 241, as shown in FIGS. 5 and 12, pivots and the clear arms 249 and 251 push the pawls 195, 197 and the pawls 203 (by action of flange 231 of swing arm 225) and 207 to disengage from their corresponding toothed racks. The locking ratchet 115 and the advance ratchet 137 will then have no restraints. As a result, the advance ratchet 137, the locking ratchet 115, the secondary advance bar 189, the advance bar 177, and the combination setting assembly 137 will be forced back to their respective initial positions by urge of springs 173 and 237, thus resetting the lock.

The lock will also be reset every time the door is opened.

As shown in FIGS. 5, 11 and 12, the lower end 253 of the clear bar 241 engages the ramped surface 255 on the locking pawl 109. When the door is unlocked and the user turns either interior knob 41 or exterior knob 27, the locking disc 61 rotates with the ramped surface 255 pushing down the lower end 253 of the clear bar 241 to cause it to pivot and thereby clear the system in the manner described above and the door becomes locked automatically.

Figure 20:
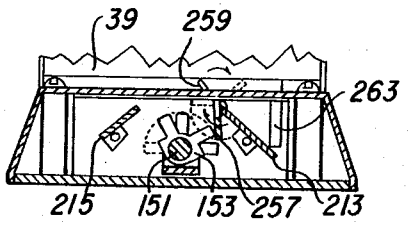
FIG. 20 is the same cross sectional view as FIG. 19 with all the new combination numbers pushed.
Figure 19:
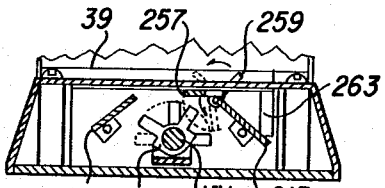
FIG. 19 is a cross sectional view of the combination lock taken along line 19—19 of FIG. 15 with all of the existing combination numbers pushed.

The access sequence or combination is set by the user without removal of the combination lock 21 from the door 23. Also, the combination number is set or changed with the help of a resetting panel 257 shown in FIG. 5. The resetting panel 257 is pivotally mounted between the upper and lower support walls 167 and 171 in a manner similar to the actuation panel 213 and is generally vertically parallel to the panel 213. The relative position of panel 257 to the actuation panel 213 and the combination setting assembly 135 is shown in FIG. 19, FIG. 20 and FIG. 10. At the top of the resetting panel 257 is a lever 259 integrally made on the resetting panel 257 and extending through the slot 261 shown in FIG. 3 on the interior cover 37 toward the interior side of the door.

To initially set or subsequently reset the combination number, the clear button 31 will be pushed to bring the entire locking system to the starting position. The protective cover 39 is then opened from the interior cover 37 to the position shown in FIG. 15.

A camming lug 263 at the bottom of the protective cover 39 shown in FIG. 3 will rotate about the mounting shaft 45 as the protective cover 39 opens and push on the outer side of the actuation panel 213 as shown in FIG. 19 and FIG. 20. Being urged by lug 263, the actuation panel 213 will open up to the position shown in FIG. 19. As it can be easily appreciated from FIG. 4 and FIG. 13, when the actuation panel 213 opens up, the other actuation panel 215 will also open up by means of the stepped flanges 227 and 229 on swing arm 225. In this manner, the combination setting interposers 153 will be permitted to rotate freely on the bar 151. Then, from the exterior side of the door, the existing opening combination numbers will be pushed. The tines 129 of the push bars pushed will rotate the corresponding combination setting interposers 153 from the dotted position in FIG. 19 to the solid partially turned position shown by the first interposer 153 in FIG. 19. When all the interposers 15 representing the existing opening combination number are rotated as above, the lever 259 will be manually turned in the direction shown by the arrow in FIG. 19. The resetting panel 257 will turn to its dotted position and, in doing so, will push all of the interposers 153 in its path fully to the right side of the bar 151 to the "incorrect" position. In this manner the resetting panel has effectively cleared the existing combination number.

The clear button will again be pushed to bring the system to the starting position. The desired combination numbers will then be pushed from the exterior side of the door to bring the corresponding interposers 153 to the solid partially turned position shown by the first interposer 153 shown in FIG. 20. Then the lever 259 will be manually turned back to its initial position as shown by the arrow in FIG. 20. The resetting panel 257 will turn to its dotted position in FIG. 20 pushing all of the interposers 15 in its path to their dotted positions which are "correct" positions and a new combination number is set.

Finally, the protective cover 39 will be closed trapping the lever 259 between interior cover 37 and the protective cover 29.

Since changing the combination number on this lock is quite easy as it can be appreciated above, the protective cover 39 is provided to prevent unauthorized persons from changing the number with ill-intention. The fastener 43 can be an Allen screw or even a cabinet lock to discourage unauthorized changing of the combination.

The lock of the present invention is also equipped with means to prevent an unauthorized person from trying to find out the access combination number by trying each push button 29 while holding down one of the push buttons 29.

FIG. 16 shows one of the push buttons 29 halfway depressed. As shown, the flat surfaces 261 on the projections 181 of the advance bar 177 are moved up to block the ramp surfaces 133 of the push bars 121 that are not being actuated. In this manner, none of the push bars 29 other than the one being actuated can be pushed. At the same time the movement of the push button being actuated is undeterred.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A combination locking assembly comprising:

push button panel means for containing a numeric pad of push buttons and presenting the push buttons for manual actuation, said panel means having tines corresponding to each of said push buttons extending away from a back side of said panel means;

combination means for maintaining a selected combination, said combination means comprising a plurality of rotatable combination interposers positioned so as to engage and be rotated about an axis by said tines when said push buttons are depressed; and a combination changing assembly comprising a panel positioned so as to pivot in a first direction and urge said combination interposers in a single direction of rotation from a partially turned position to a first incorrect position and erase a previously selected combination from said combination means, and, subsequently to pivot in a second direction and urge a selected few of said combination interposers to a second correct position.

2. An assembly as in claim 1, further comprising:

lever means operatively connected to said panel for pivoting said panel in said first and second directions.

3. An assembly as in claim 2, further comprising:

axially aligned non-rotatable spacer means positioned between adjacent ones of said plurality of combination interposers for separating the rotating displacements of each of said interposers.

4. An assembly as in claim 2, further comprising:

pivoting cover means for covering said combination changing assembly including fastener means for prevention of unauthorized access to said combination changing assembly.

5. A combination lock assembly comprising:

a push button panel having front and back sides and push buttons extending therethrough, each of said buttons having front and back ends and having push bars extending from said back end, said push bars having ramped surfaces on an end thereof remote from said push button;

advance bar means for engaging and being displaced by said ramped surfaces when said push buttons are depressed, said advance bar means having a plurality of arms extending therefrom and positioned so as to engage said ramped surfaces; wherein, said respective arms and ramped surfaces engage and displace said advance bar to a position such that additional push buttons are prevented from being depressed when said ramped surface of additional push buttons jam against end portions of said ramped arms of said displaced advance bar means.

6. An assembly as in claim 5, wherein:

said push bars further comprise a pair of tines extending therefrom and said advance bar means extends vertically between said tines.

7. An assembly as in claim 6, further comprising:

combination means for maintaining a selected combination comprising a plurality of rotatable combination interposers positioned so as to engage and be rotated about an axis by said tines when said push buttons are depressed.

8. An assembly as in claim 7, further comprising:

a combination changing assembly comprising a panel positioned so as to pivot in a first direction and urge said combination interposers in a single direction of rotation from a partially turned position to a first incorrect position and urge a selected few of said combination interposers to a second correct position so as to select a new combination.

9. An assembly as in claim 5, further comprising:

locking ratchet means for selectively locking and unlocking a latching assembly; and secondary advance bar means operatively connected to said advance bar means for transferring the displacement of said advance bar means to said locking ratchet means to urge said locking ratchet means to a displaced location.

10. An assembly as in claim 9, further comprising:

locking pawl means for maintaining the displaced location of said locking ratchet means.

11. A method of changing the combination of a locking combination assembly having a pushbutton keypad, combination setting assembly, and a cover member, comprising the steps of:

opening said cover member to enable access to said combination setting assembly, urging a combination setting panel in a first direction to clear the existing combination, entering a desired combination on said pushbutton keypad, and urging said combination setting panel in a second direction to set the desired combination in the combination assembly.

12. A combination locking assembly, comprising:

push button panel means for containing a numeric pad of push buttons and presenting the push buttons for manual actuation, said panel means having tines corresponding to each of said push buttons extending away from a back side of said panel means;

combination means for maintaining a selected combination, said combination means comprising a plurality of rotatable combination interposers positioned so as to engage and be rotated about an axis by said tines when said push buttons are depressed; wherein, when said push buttons are depressed, the relative positioning of the actuating tine and the combination interposer is fixed from the moment actuation of the pushbutton occurs until the pushbutton is released.

* * * * *